US010342998B2

(12) United States Patent
Makhlouche et al.

(10) Patent No.: US 10,342,998 B2
(45) Date of Patent: Jul. 9, 2019

(54) RESPIRATORY PROTECTION HOOD

(71) Applicant: L'Air Liquide, Societe Anonyme pour l'Etude et l'Exploitation des Procedes Georges Claude, Paris (FR)

(72) Inventors: Rachid Makhlouche, Genoble (FR); Jean-Michel Cazenave, Seyssins (FR); Freddy Dumont, Les Abrets (FR); Christian Rolland, Vif (FR); Benoit Rossignol, Champagnier (FR)

(73) Assignee: L'Air Liquide, Societe Anonyme Pour L'Etude Et L'Exploitation Des Procedes Georges Claude, Paris (FR)

( * ) Notice: Subject to any disclaimer, the term of this patent is extended or adjusted under 35 U.S.C. 154(b) by 763 days.

(21) Appl. No.: 14/897,099

(22) PCT Filed: May 2, 2014

(86) PCT No.: PCT/FR2014/051050
§ 371 (c)(1),
(2) Date: Dec. 9, 2015

(87) PCT Pub. No.: WO2014/199029
PCT Pub. Date: Dec. 18, 2014

(65) Prior Publication Data

US 2016/0121146 A1 May 5, 2016

(30) Foreign Application Priority Data

Jun. 12, 2013 (FR) ..... 13 55431

(51) Int. Cl.
*A62B 17/04* (2006.01)
*A62B 7/02* (2006.01)
(Continued)

(52) U.S. Cl.
CPC ..... *A62B 17/04* (2013.01); *A62B 7/02* (2013.01); *A62B 7/08* (2013.01); *A62B 7/14* (2013.01); *A62B 9/02* (2013.01)

(58) Field of Classification Search
CPC ..... A41D 13/1153; A62B 7/00; A62B 7/02; A62B 7/08; A62B 7/14; A62B 9/00;
(Continued)

(56) References Cited

U.S. PATENT DOCUMENTS 4,116,237 A * 9/1978 Birch ..... A62B 17/04 128/201.11
4,552,140 A 11/1985 Cowley et al.
(Continued)

FOREIGN PATENT DOCUMENTS

FR 2 582 524 12/1986
GB 2119660 A * 11/1983 ..... A62B 7/02
GB 2238480 A * 6/1991 ..... A62B 7/02

OTHER PUBLICATIONS

International Search Report for PCT/FR2014/051050, dated Nov. 5, 2014.
(Continued)

*Primary Examiner* — Jan Christopher L Merene
*Assistant Examiner* — Joseph D. Boecker
(74) *Attorney, Agent, or Firm* — Christopher J. Cronin

(57) ABSTRACT

A hood comprising a flexible envelope and a reservoir of oxygen comprising a calibrated outlet orifice that leads into the internal volume of the envelope, the outlet orifice being closed off by a removable stopper, characterized in that the reservoir of pressurized oxygen comprises two independent storage compartments, a first compartment of which communicates with the outlet orifice and a second compartment of which is isolated from the outlet orifice via a sealed partition provided with a member for opening the partition,
(Continued)

the opening member being switchable between a first configuration which prevents fluidic communication between the second compartment and the outlet orifice and a second configuration that allows fluidic communication between the second compartment and the outlet orifice, the opening member being sensitive to the pressure difference between the second compartment and the first compartment and being configured to automatically switch from the first to the second configuration when the pressure difference between the second compartment and the first compartment is less than a given threshold.

10 Claims, 2 Drawing Sheets

(51) Int. Cl.
*A62B 7/08* (2006.01)
*A62B 7/14* (2006.01)
*A62B 9/02* (2006.01)

(58) Field of Classification Search
CPC ..... A62B 9/02; A62B 9/027; A62B 17/00; A62B 17/04; A62B 18/00; A62B 18/003; A62B 18/02; A62B 18/084; A42B 3/28; A42B 3/288
See application file for complete search history.

(56) References Cited

U.S. PATENT DOCUMENTS

| | | | | | |
|---|---|---|---|---|---|
| 4,889,113 | A * | 12/1989 | Pelloux-Gervais .... | A62B 17/04 | 128/201.25 |
| 5,003,973 | A * | 4/1991 | Ford ..... | A42B 3/044 | 128/201.25 |
| 5,676,135 | A * | 10/1997 | McClean ..... | A62B 7/02 | 128/205.22 |
| 2014/0261406 | A1* | 9/2014 | Fabian ..... | B63C 9/18 | 128/202.14 |
| 2016/0151649 | A1* | 6/2016 | Makhlouche ..... | A62B 7/02 | 128/201.28 |

OTHER PUBLICATIONS

French Search Report and Written Opinion for FR1355431, dated Feb. 24, 2014.

* cited by examiner

RESPIRATORY PROTECTION HOOD

CROSS-REFERENCE TO RELATED APPLICATIONS

This application is a § 371 of International PCT Application PCT/FR2014/051050, filed May 2, 2014, which claims § 119(a) foreign priority to French patent application 1355431, filed Jun. 12, 2013.

BACKGROUND

Field of the Invention

The present invention relates to respiratory equipment.

The invention relates more particularly to a respiratory protection hood comprising a flexible bag intended to be slipped over the head of a user and a reservoir of pressurized oxygen comprising a calibrated outlet orifice opening into the internal volume of the flexible bag, the outlet orifice being closed off by a removable or contrived-rupture stopper.

Related Art

This type of device, which needs to comply with standard TSO-C-116a, is conventionally used onboard airplanes when the cabin atmosphere is vitiated (depressurization, smoke, chemical agents, etc.).

This equipment, also referred to as a hood, must notably allow the flight crew to tackle the problem, provide emergency assistance to the passengers, and manage a potential evacuation of the aircraft.

The technical specifications for such devices are defined according to class of use (in-flight damage, protection against high-altitude hypoxia, emergency evacuation on the ground, etc.).

Each of these classes is associated with a corresponding level of effort that the user needs to be able to sustain when using the equipment.

Because the amount of oxygen consumed by the user is proportional to the effort sustained, the device needs to be able to supply the user with enough oxygen to meet the demands of use.

The hood may notably be provided both for preventing hypoxia at an altitude of 40 000 feet two minutes after it has been donned and then, in the final minutes of use, supply enough oxygen to allow evacuation.

Known respiratory equipment chiefly employs two types of oxygen source:

- a chemical brick (also referred to as a "chemical oxygen generator") that generates oxygen by combustion (potassium superoxide—$KO_2$, sodium chlorate—$NaClO_3$, etc.), or
- a compressed-oxygen reservoir associated with a calibrated orifice.

The first type allows the supply of a flow rate of oxygen that increases until it reaches a relatively constant level before dropping off rapidly at the end of combustion.

Generators of the chemical oxygen generator type, if correctly sized, may constitute a source of oxygen that is capable of meeting the desired requirements, but this solution does have a major disadvantage: the combustion reaction of the chemical oxygen generator is highly exothermic.

As a result, the external surface temperature of the device may easily exceed 200° C. and ignite any combustible material in contact with it (a fatal accident has already occurred following accidental activation of such a chemical oxygen generator in a transport container situated in the hold of an airplane).

This type of device also has the disadvantage of requiring a certain time for the oxygen flow rate to rise upon startup. This may entail the addition of an additional oxygen capacity for startup. Finally, these devices require filters in order to remove the impurities generated by the chemical oxygen-producing reaction.

The second type (pressurized-oxygen reservoir associated with a calibrated orifice) supplies an oxygen flow rate that decreases exponentially, in proportion to the change in pressure inside the reserve.

Hoods using this second type thus generally comprise a source of oxygen that allows an individual to be supplied with oxygen for 15 minutes. This equipment may also have a means of limiting the pressure inside the hood (for example an overpressure relief valve).

This technology using compressed oxygen in a sealed container associated with a calibrated orifice is safer. Nevertheless, in order to be able to meet certain usage scenarios (substantial oxygen consumption at the end of use corresponding, for example, to an emergency evacuation of the aircraft), the container needs to have a volume that is too great for the target size. Another solution may be to provide a high initial pressure (in excess of 250 bar). That generates a high initial flow rate, for example of more than ten normal liters per minute (Nl/min) so as to be able to have enough flow rate at the end of use (for example more than 2 Nl/min at the fifteenth minute of use of the equipment). An excessive oxygen flow rate, although advantageous in affording protection against hypoxia, is, however, problematical if there is a fire onboard the aircraft because the excess oxygen will be discharged from the equipment through the overpressure relief valve thereof and may feed the flames. In addition, it entails oversizing the oxygen reservoir and this is a major disadvantage in terms of mass, size and cost.

SUMMARY OF THE INVENTION

The invention relates to a hood using a pressurized-oxygen reservoir.

One object of the present invention is to alleviate all or some of the abovementioned disadvantages of the prior art.

One object of the invention may notably be to propose a hood that makes it possible to supply a relatively large quantity of oxygen at the start of use (to prevent high-altitude hypoxia) while at the same time allowing a sufficient quantity of oxygen to be supplied at the end of use (after ten or fifteen minutes) to allow evacuation.

To this end, the hood according to the invention, in other respects in accordance with the generic definition thereof given in the above preamble, is essentially characterized in that the pressurized-oxygen reservoir comprises two independent storage compartments of which a first compartment communicates with the outlet orifice and a second compartment is isolated from the outlet orifice via a fluidtight separation provided with a member for opening the separation, the opening member being able to switch between a first configuration that prevents fluidic communication between the second compartment and the outlet orifice, and a second configuration that allows fluidic communication between the second compartment and the outlet orifice, the opening member being sensitive to the pressure differential between the second compartment and the first compartment and configured to switch automatically from the first to the second configuration when the pressure differential between the second compartment and the first compartment is below a determined threshold.

Moreover, some embodiments of the invention may comprise one or more of the following features:

- the fluidtight separation equipped with an opening member forms a boundary common to the two storage compartments in the reservoir, in its second configuration the second compartment communicating with the first compartment,
- the opening member comprises a fluidtight rupture disk of which the two faces are in communication with the first and second compartments respectively, the rupture disk being configured to break when subjected to a pressure differential of between 200 bar and 50 bar, and preferably between 150 bar and 100 bar,
- the rupture disk constitutes the fluidtight separation between the first and second compartments,
- the opening member comprises a mobile shutter urged by a return member toward a position of closure of a passage orifice between the first and second compartments, this position of closure constituting said first configuration,
- the shutter is also subjected to a force of opening of the passage orifice which force is generated by the pressure of the gas stored in the second compartment when the pressure in the second compartment exceeds the pressure in the first compartment, the shutter being moved into a position of opening corresponding to the second configuration when the pressure differential between the second and first compartments is greater than a determined threshold,
- the flexible bag is fluidtight,
- the oxygen reservoir is secured to the base of the flexible bag,
- the oxygen reservoir is of tubular overall shape, notably shaped into a C, to allow it to be placed around the neck of a user,
- the base of the flexible bag forms a flexible diaphragm intended to fit around the neck of a user,
- the hood comprises a $CO_2$ absorption device which communicates with the inside of the bag,
- the bag has an opening through which the $CO_2$ absorption device is positioned,
- each compartment has a volume of between 0.1 liter and 0.4 liter,
- prior to opening, each compartment stores a quantity of oxygen-enriched gas or pure oxygen of between 10 g and 80 g,
- the calibrated orifice (4) has a diameter of between 0.05 mm and 0.1 mm.

The invention may also relate to any alternative method or device comprising any combination of the features above or below.

BRIEF DESCRIPTION OF THE FIGURES

Other specifics and advantages will become apparent from reading the following description, which is given with reference to the figures in which.

DETAILED DESCRIPTION OF THE INVENTION

Figure 1:
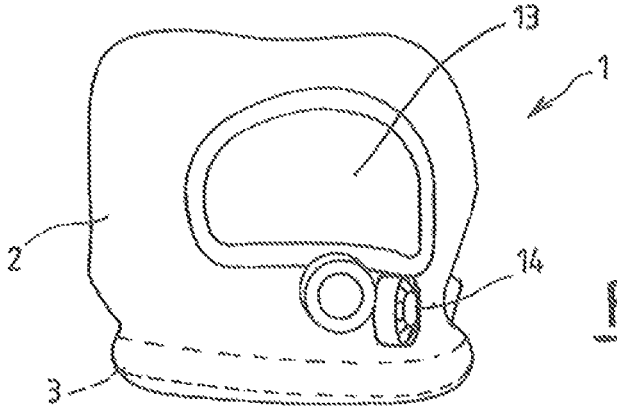
FIG. 1 depicts a face-on and schematic view illustrating one example of a hood according to the invention, FIG. 2 schematically and partially depicts a detail of the hood of FIG. 1, illustrating a first embodiment of the pressurized-oxygen reservoir.

The hood illustrated in FIG. 1 comprises in a conventional way a flexible bag 2 (preferably fluidtight) intended to be slipped over the head of a user. A transparent visor 13 is provided on the front face of the bag 2. The hood 1 also comprises a pressurized-oxygen reservoir 3 positioned for example at the base of the bag 2.

In the conventional way, the base of the flexible bag 2 may comprise or form a flexible diaphragm intended to be fitted around the neck of a user in order to seal at this point.

In the conventional way also, the hood 1 may comprise a $CO_2$ absorption device which communicates with the inside of the bag 2, so as to remove $CO_2$ from the air exhaled by the user. For example, the bag 2 may comprise an opening across which the $CO_2$ absorption device is positioned. Likewise, another opening may be provided for a relief valve 14 provided for preventing an overpressure in the bag 2.

As illustrated in FIG. 1, the oxygen reservoir 3 may have a tubular overall shape, notably shaped as a C, to allow it to be placed around the neck of a user.

Figure 2:
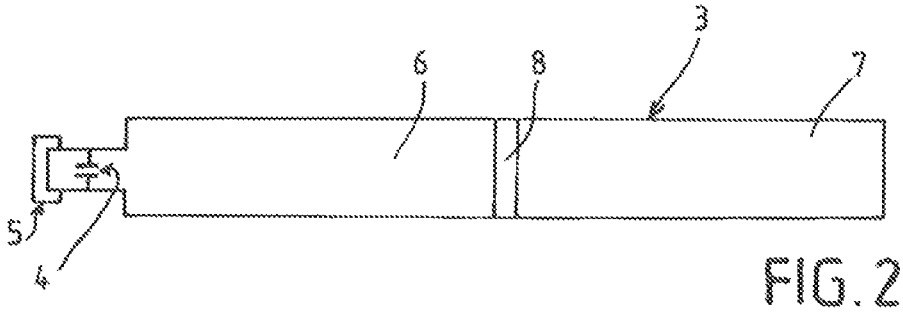

As illustrated in FIG. 2, the reservoir 3 comprises a calibrated outlet orifice 4 closed by a fluidtight stopper 5 and opening into the internal volume of the flexible bag 2 so as to deliver pure gaseous oxygen or an oxygen-enriched gas to the user. The reservoir 3 also comprises at least one filling orifice. For the sake of simplicity, the filling orifice or orifices has or have not been depicted.

The outlet orifice 4 is normally closed off by a removable or contrived-rupture stopper 5 and will be opened only in the event of use.

According to one advantageous feature, the pressurized-oxygen reservoir 3 comprises two independent and distinct storage compartments 6, 7. A first compartment 6 communicates with the calibrated outlet orifice 4 and a second compartment 7 is, to start off with, isolated from the outlet orifice 4 via a fluidtight separation equipped with a member 8 for automatic opening of the separation.

What that means to say is that when the hood 1 is activated (when the stopper 5 of the calibrated orifice 4 is opened), only the first pressurized-oxygen compartment 6 will empty.

The opening member 8 can be switched between a first configuration that prevents fluidic communication between the second compartment 7 and the outlet orifice 4 (at the start of activation) and a second configuration that allows fluidic communication between the second compartment 7 and the outlet orifice 4 (when the pressure in the first compartment 6 has dropped to a determined level).

To this end, the opening member is sensitive to the pressure differential between the second compartment 7 and the first compartment 6 and is configured to switch automatically from the first to the second configuration when the pressure differential between the second compartment 7 and the first compartment 6 is below a determined threshold. In the example of FIG. 2, the opening member consists of a fluidtight rupture disk 8 the two faces of which are in communication with the first 6 and second 7 compartments respectively. The rupture disk 8 is configured in the conventional way to break when subjected to a pressure differential of between 200 bar and 50 bar and preferably between 150 bar and 100 bar.

Without this implying any limitation whatsoever, the rupture disk 8 may for example be a rupture disk of the scored and domed type (to eliminate the risk of fragmentation) and made of a material compatible with oxygen, for example stainless steel (for example a rupture disk marketed under the reference "Fike POLY-SD").

As illustrated in FIG. 2, the rupture disk 8 may form a fluidtight separation which delineates and separates the two compartments 6, 7. After the disk 8 has ruptured, the second compartment 7 and the first compartment 6 communicate and form one single same volume for the pressurized gas remaining in the reservoir 3.

As detailed hereinafter, this design allows a high gas flow rate to be delivered at the start of use of the hood 1 while at the same time making it possible to supply a sufficient flow rate at the end of use (after 10 to 15 minutes for example).

The relatively high flow rate at the start of use will allow the sealed volume formed by the bag 2 to be filled and will constitute a reserve of oxygen before the flow rate supplied decreases rapidly. The user will be able to breathe the oxygen formed by this reserve for a few minutes even if the flow rate supplied becomes relatively low. Thereafter, the rupturing of the disk will trigger a further increase in the flow rate thus replenishing the reserve of oxygen which will be enough to complete the duration of use (for example fifteen minutes).

Figure 3:
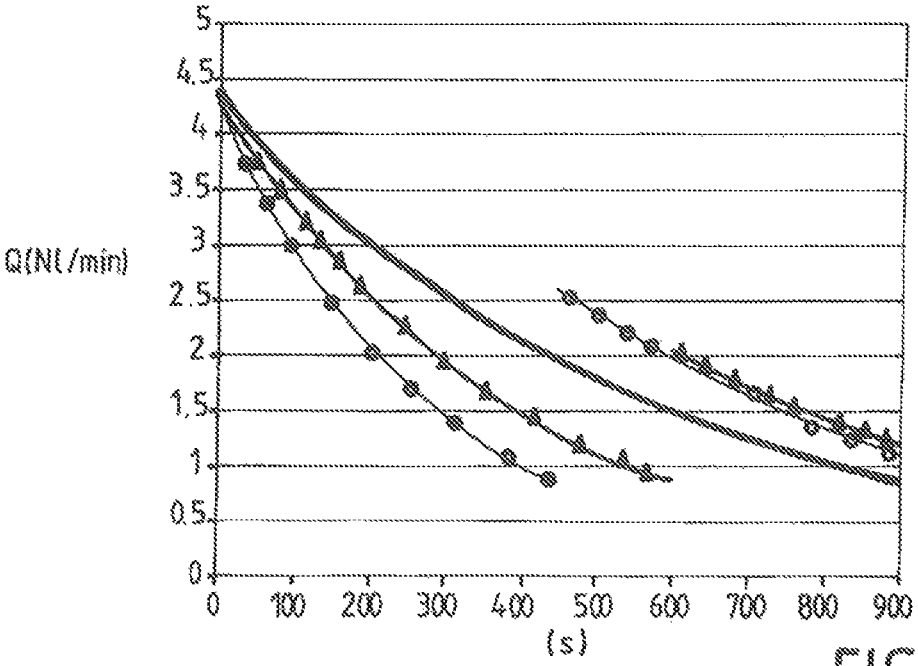
FIG. 3 illustrates comparative examples of curves of oxygen flow rate supplied as a function of time by reservoirs according to FIG. 2 and by a reservoir according to the prior art, FIG. 4 schematically and partially depicts a detail of the hood of FIG. 1, illustrating a second possible embodiment of the pressurized-oxygen reservoir.

FIG. 3 illustrates in continuous line a decreasing curve indicative of the gas flow rate Q at the outlet of the calibrated orifice 4 in normal liters (Nl, namely in number of liters per minute under determined temperature and pressure conditions of 0° C. and 1 atm) as a function of time (in seconds s) according to the prior art. The way in which the flow rate Q supplied in normal liters per minute evolves can be modeled as an exponential formula of the type $Q(t)=A\,e^{-Bt}$ in which A and B are constants which are functions of the diameter of the calibrated orifice, of the volume of the reservoir, of the quantity and nature of the gas and of the temperature thereof.

This example corresponds for example to the following conditions: a reservoir volume of 0.26 liter, a quantity of pure oxygen of 58 g and a calibrated orifice with a diameter equal to 0.06 mm.

It may be noted that, although the oxygen flow rate supplied is satisfactory in the first few minutes, after around ten minutes, the oxygen flow rate supplied drops below 2 Nl per minute.

The curves with triangles symbolize the variation in flow rate Q supplied at the outlet of the calibrated orifice 4 according to a first example of reservoir 3 according to FIG. 2. The reservoir 3 with two compartments 6, 7 contains, for example, the same quantity of gas as before but split between the two compartments, and the calibrated orifice 4 has the same diameter (0.06 mm).

Starting from the same initial flow rate value (around 4.5 Nl/second) as before, the flow rate decreases first of all following an exponential-type curve. This first curve, which is slightly below the curve according to the prior art, corresponds to the emptying of the first compartment 6 of the reservoir. When the pressure within the first compartment 6 reaches a determined low threshold the disk 8 ruptures (at t=600 seconds approximately in FIG. 3). The difference in pressure across the two faces of the disk 8 in fact causes it to rupture, the effect of this being to place the two compartments 6, 7 in communication.

The second compartment 7 will supply an additional quantity of gas that brings about a sharp increase in the pressure seen by the calibrated orifice 4 and therefore in the flow rate of gas supplied by the reservoir 3. The gas flow rate will then decrease again (cf. the second decreasing curve in FIG. 3, for example of exponential appearance).

The two curves with circles illustrate another example of the emptying of a two-compartment reservoir 3 according to FIG. 2 by varying the operating conditions in such a way as to shift the moment at which the disk 8 ruptures.

Specifically, by varying notably the values of the volumes of the compartments 6, 7, the quantities of gas contained therein and the rating of the rupture disk, it is possible to shift the moment at which the disk 8 ruptures and to modify the values of the flow rate curves as required. Thus, for example, for an emptying duration lasting 15 minutes in total, if the first compartment 6 constitutes two-thirds of the total volume of the reservoir and the second compartment 7 constitutes the final third, rupturing of the disk 8 will occur more or less two-thirds of the way through the 15-minute emptying duration (namely around the 10th minute after the opening of the orifice 4).

Of course, the relative volumes are not the only parameter to influence the moment at which the disk 8 ruptures. Specifically, this moment of rupturing is also dependent notably on the rating of the disk 8, on the initial pressure levels in the compartments (it is, for example, possible to fill the two compartments with different initial pressures).

One configuration that makes it possible to obtain the flow rates of the curve marked with triangles may be as follows: two compartments of the same volume (0.1251) both initially at a pressure level of 160 bar of oxygen, a disk that ruptures when the pressure difference reaches 140 bar and a calibrated orifice (orifice plate) with a diameter of 0.06 mm.

One configuration that makes it possible to obtain the curve marked with the circles may be as follows: two compartments with an identical volume of 0.1251 at an initial pressure of 160 bar and a rupture disk 8 that ruptures when the pressure difference reaches 120 bar.

As can be seen from the curves, the proposed architecture makes it possible to make the supply of oxygen more flexible over the duration of use of the equipment without significantly increasing the cost or mass of the reserve or significantly impairing the reliability of the whole (rupture disks, because they are used as safety elements, are reliable).

The way in which the level of oxygen in the hood 1 evolves as a function of flow rate supplied by the reservoir 2 can be calculated using a model.

The proposed architecture with two (or even three or more) compartments activated in sequence makes it possible to generate an initial flow rate that is sufficient to fill the internal volume of the hood 1 in a few minutes and thus constitute enough of a reserve of oxygen until the disk ruptures. Specifically, for the same initial pressure in the first compartment 6, the initial gas flow rate will be the same for a container with just one compartment.

This flow rate of gas from the first compartment 6 will decrease sufficiently rapidly (because the first compartment is, in relative terms, smaller than that of a single reservoir according to the prior art). This will make it possible to limit the amount of oxygen discharged through the overpressure relief valve. The rupturing of the disk 8 will occur at a determined moment when the quantity of oxygen in the hood reaches a relatively low value that is to be determined.

This will make it possible to increase the amount of oxygen available in the hood at the end of use, by limiting the discharge of high-oxygen-content gaseous mixture to the outside at the start of use. This makes it possible to optimize the supply of oxygen over the course of time.

In the solution of the prior art, the gas flow rate supplied fills the internal volume of the hood in the first few minutes of use (between two and three minutes) and thereafter, excess oxygen injected into the equipment will, to a large extent, be discharged through the relief valve and therefore not used. The structure described hereinabove makes it possible to avoid the disadvantages of the solution of the prior art by better metering the amount of oxygen delivered.

Such a reservoir 3 may be made up of two tubes of the same diameter, of which one has an end fitting fitted with the calibrated orifice 4 and with a filling port and the other compartment 7 may also comprise a filling orifice (which has not been depicted for the sake of simplicity).

Of course, during the filling of the two compartments 6, 7 the pressure differential between the two compartments 6, 7 needs to be below the level that will cause the disk 8 to rupture.

A filter may be provided in the reservoir 3 on the side of the calibrated orifice 4 to prevent fragments from the ruptured disk 8 from migrating (notably because of the risk of fire).

Figure 4:
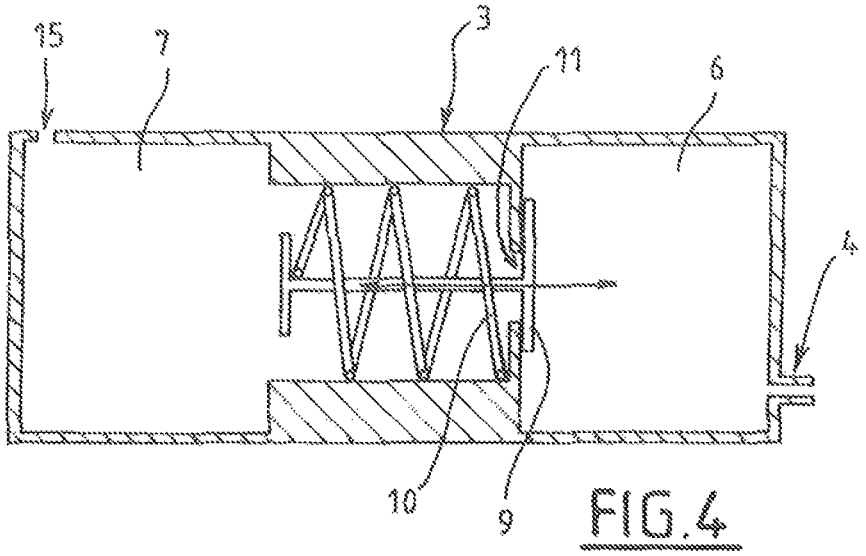

FIG. 4 illustrates an alternative form of embodiment of the invention in which the pressurized-gas reservoir 3 has no rupture disk 8 between the two compartments 6, 7 but has a mobile shutter 9 able to move relative to a passage orifice 11. Elements identical to those described previously are denoted by the same numerical references. As illustrated, a filling orifice 15 may be provided at the second compartment 7.

What that means to say is that the member for opening between the two compartments 6, 7 comprises a mobile shutter 9 urged by a return member 10 (such as a spring) toward a position of closure of a passage orifice 11 between the first 6 and second 7 compartments.

In addition, the shutter 9 is also subjected to a force of opening of the passage orifice 11 when the pressure in the second compartment 7 exceeds the pressure in the first compartment 6. When this pressure differential between the two compartments 6, 7 is high enough (above a determined threshold), the force of opening exceeds the force of closure supplied by the spring 10.

Figure 5:
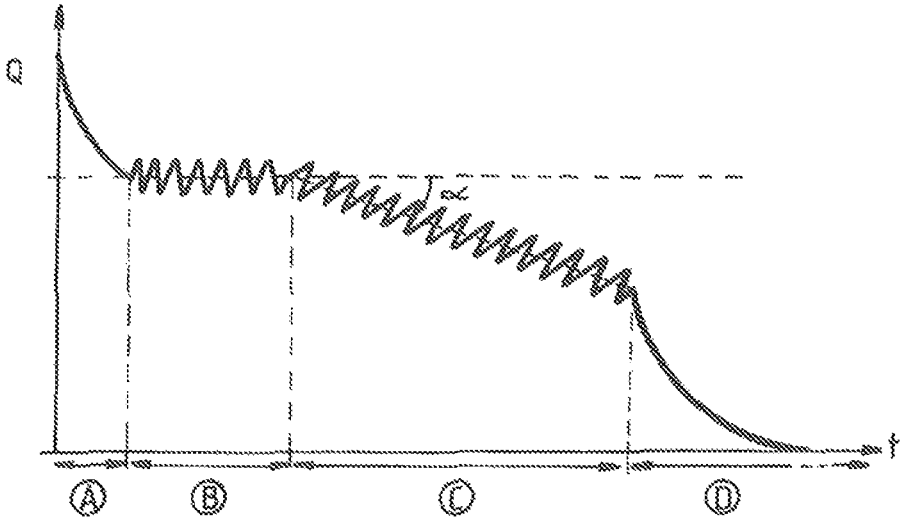
FIG. 5 illustrates an example of curves of oxygen flow rate supplied by the reservoir of FIG. 4 as a function of time.

FIG. 5 illustrates an example of a curve of flow rate Q at the outlet of the calibrated orifice 4 as a function of time for such a structure.

Initially, after the opening of the calibrated orifice 4, the first compartment 6 empties alone because the shutter 9 is in the closed position. The flow rate decreases along an exponential curve (period A in FIG. 5).

Thereafter, the shutter 9 may start to oscillate open/closed because equilibrium between the opposing forces of closure (spring) and of opening (differential pressure across the shutter 9) is achieved. The flow rate remains relatively constant while fluctuating (period B in FIG. 5).

Next, because of the drop in pressure in the first compartment 7, the shutter 9 ultimately opens because the force of opening generated by the pressure differential on the shutter 9 exceeds the force of closure of the spring 10. The pressure within the second compartment 7 decreases, shifting the point of equilibrium. The gas flow rate leaving the calibrated outlet orifice 4 decreases, oscillating (period C in FIG. 5).

Finally, the pressure in the second compartment 7 becomes too low to oppose the force of closure of the spring 10. The shutter 9 remains in a closed position and the gas flow rate from the first compartment 6 decreases for example exponentially (period D in FIG. 5).

This architecture may make it possible to generate a relatively constant gas flow rate over a determined period (period B in FIG. 5).

However, this solution does have the major disadvantage of trapping a small quantity of oxygen in the second compartment 7. However, the lower the spring rate of the spring 10 of the shutter 9, the smaller this trapped quantity will be. In addition, the lower the spring rate of the spring 10, the longer the stages B and C will be.

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims. The present invention may suitably comprise, consist or consist essentially of the elements disclosed and may be practiced in the absence of an element not disclosed. Furthermore, if there is language referring to order, such as first and second, it should be understood in an exemplary sense and not in a limiting sense. For example, it can be recognized by those skilled in the art that certain steps can be combined into a single step.

The singular forms "a", "an" and "the" include plural referents, unless the context clearly dictates otherwise.

"Comprising" in a claim is an open transitional term which means the subsequently identified claim elements are a nonexclusive listing i.e. anything else may be additionally included and remain within the scope of "comprising." "Comprising" is defined herein as necessarily encompassing the more limited transitional terms "consisting essentially of" and "consisting of"; "comprising" may therefore be replaced by "consisting essentially of" or "consisting of" and remain within the expressly defined scope of "comprising".

"Providing" in a claim is defined to mean furnishing, supplying, making available, or preparing something. The step may be performed by any actor in the absence of express language in the claim to the contrary.

Optional or optionally means that the subsequently described event or circumstances may or may not occur. The description includes instances where the event or circumstance occurs and instances where it does not occur.

Ranges may be expressed herein as from about one particular value, and/or to about another particular value. When such a range is expressed, it is to be understood that another embodiment is from the one particular value and/or to the other particular value, along with all combinations within said range.

All references identified herein are each hereby incorporated by reference into this application in their entireties, as well as for the specific information for which each is cited.

What is claimed is:

1. A respiratory protection hood comprising: a flexible bag adapted and configured to be slipped over a head of a user; and a reservoir of pressurized oxygen comprising a calibrated outlet orifice opening into an internal volume of the flexible bag, the outlet orifice being closed off by a removable or contrived-rupture stopper, wherein:

the pressurized-oxygen reservoir comprises two independent storage compartments of which a first compartment communicates with the outlet orifice and a second compartment is isolated from the outlet orifice via a fluidtight separation provided with a member for opening the separation;

the opening member is able to switch between a first configuration that prevents fluidic communication between the second compartment and the outlet orifice, and a second configuration that allows fluidic communication between the second compartment and the outlet orifice;

the opening member is sensitive to a pressure differential between the second compartment and the first compartment and is adapted and configured to switch automatically from the first configuration to the second configuration when the pressure differential between the second compartment and the first compartment is above a determined threshold.

2. The hood of claim 1, wherein:

the fluidtight separation provided with the member for opening the separation forms a boundary common to the first and second compartments in the reservoir; and while in the second configuration, the second compartment fluidly communicates with the first compartment.

3. The hood of claim 1, wherein:

the opening member comprises a fluidtight rupture disk having first and second faces that are in communication with the first and second compartments, respectively; and the rupture disk is adapted and configured to break when subjected to a pressure differential of between 200 bar and 50 bar.

4. The hood of claim 3, wherein the rupture disk constitutes the fluidtight separation between the first and second compartments.

5. The hood of claim 1, wherein the opening member comprises a mobile shutter urged by a return member toward a position of closure of a passage orifice between the first and second compartments, this position of closure constituting said first configuration.

6. The hood of claim 5, wherein the shutter is also subjected to a force of opening of the passage orifice which force is generated by the pressure of the gas stored in the second compartment when the pressure in the second compartment exceeds the pressure in the first compartment, the shutter being moved into a position of opening corresponding to the second configuration when the pressure differential between the second and first compartments is greater than the determined threshold.

7. The hood of claim 1, wherein the flexible bag is fluidtight.

8. The hood of claim 1, wherein the oxygen reservoir is secured to the base of the flexible bag.

9. The hood of claim 1, wherein the oxygen reservoir has a C-shaped tubular overall shape that allows the oxygen reservoir to be placed around a neck of the user.

10. The hood of claim 1, wherein a base of the flexible bag forms a flexible diaphragm intended to fit around a neck of the user.

* * * * *